US011313014B1

(12) United States Patent
Wu et al.

(10) Patent No.: US 11,313,014 B1
(45) Date of Patent: Apr. 26, 2022

(54) NICKEL-BASED SUPERALLOY AND MATERIAL THEREOF

(71) Applicant: NATIONAL CHUNG SHAN INSTITUTE OF SCIENCE AND TECHNOLOGY, Taoyuan (TW)

(72) Inventors: Tung-Chun Wu, Taoyuan (TW); Chao-Nan Wei, Taoyuan (TW); Hui-Yun Bor, Taoyuan (TW); Shea-Jue Wang, Taoyuan (TW)

(73) Assignee: NATIONAL CHUNG SHAN INSTITUTE OF SCIENCE AND TECHNOLOGY, Taoyuan (TW)

( * ) Notice: Subject to any disclaimer, the term of this patent is extended or adjusted under 35 U.S.C. 154(b) by 0 days.

(21) Appl. No.: 17/191,733

(22) Filed: Mar. 4, 2021

(51) Int. Cl.
*C22C 19/05* (2006.01)

(52) U.S. Cl.
CPC ..... *C22C 19/056* (2013.01)

(58) Field of Classification Search
CPC ..... C22C 19/056; C22F 1/10
See application file for complete search history.

(56) References Cited

U.S. PATENT DOCUMENTS

| | | | |
|---|---|---|---|
| 4,336,312 | A | 6/1982 | Clark et al. |
| 5,374,393 | A | 12/1994 | Gettliffe et al. |
| 5,403,547 | A | 4/1995 | Smith et al. |
| 5,425,912 | A | 6/1995 | Smith et al. |
| 5,476,555 | A | 12/1995 | Erickson |
| 6,730,264 | B2 | 5/2004 | Cao |
| 7,156,932 | B2 | 1/2007 | Cao et al. |
| 8,394,210 | B2 | 3/2013 | Cao et al. |

FOREIGN PATENT DOCUMENTS

| | | | |
|---|---|---|---|
| TW | 202022126 | A | 6/2020 |
| TW | 202022132 | A | 6/2020 |

*Primary Examiner* — Jessee R Roe

(57) ABSTRACT

The present invention provides a nickel-based superalloy material, which comprises 0.06 wt % or less carbon, 11.61~11.93 wt % chromium, 1.52~2.85 wt % titanium, 5.89~6.08 wt % aluminum, 0.009 wt % or less boron, 0.07 wt % or less zirconium, 2.16~2.18 wt % niobium, 4.22~4.29 wt % molybdenum, and the balance being composed of nickel and incidental impurities, whereby the effect of obtaining the nickel-based superalloy with better mechanical properties can be achieved.

6 Claims, 2 Drawing Sheets

| Tensile results at medium temperature (650℃) | Tensile strength (MPA) | Yield strength (MPA) | Elongation (%) |
|---|---|---|---|
| T1 | 1010 | 925 | 3.0 |
| T2 | 1130 | 960 | 6.2 |
| T3 | 790 | ------ | ----- |
| Base material | 901 | 790 | 6.2 |

FIG. 3

NICKEL-BASED SUPERALLOY AND MATERIAL THEREOF

BACKGROUND OF THE INVENTION

1. Field of the Invention

The present disclosure relates to a nickel-based superalloy and material thereof, and in particular to a nickel-based superalloy with low density and high strength and material thereof.

2. Description of the Related Art

As described in U.S. Pat. No. 4,336,312, by controlling the reduction in aluminum content and the increase in carbon content, the composition of nickel-based casting alloys used for high-temperature structural parts is changed, thereby significantly reducing the occurrence of metal cracking in the heat-affected zone during fusion welding operations. In order to prevent the strain-age cracking of the weldment during thermal cycling after fusion welding, the modified nickel-based casting alloy was thermally adjusted before welding. The composition of the modified nickel-based casting alloy is (weight percentage): 0.05~0.07% carbon, 11~13% chromium, 0.5~1% titanium, 5.5~6.5% aluminum, 0.05~0.15% zirconium, nickel and other incidental impurities. In terms of the mechanical properties of the modified nickel-based casting alloy at room temperature, the tensile strength is up to 859.9 MPa, the yield strength is up to 844 MPa, and the elongation is up to 3.5%.

As described in U.S. Pat. No. 5,374,393, it has been found that alloys for turbine engines that are added with a small amount of gold have higher performance than similar alloys that do not contain gold. These improved alloys have special applications in gas turbines and engines. Its composition is (weight percentage): 0.02~0.08% carbon, 46~59% nickel, 10~14% cobalt, 10~15% chromium, 3.3~4.4% titanium, 2.2~3.2% aluminum, 0.04~0.06% boron, 0.05~0.06% zirconium, 0.02~0.08% molybdenum and 0.02~20% gold. This patent mainly focuses on the addition of gold and the method used to reduce the diffusion rate of oxygen in the high-temperature alloy used in gas turbines, and does not mention the mechanical properties and density of the alloy.

U.S. Pat. No. 5,403,547 discloses an anti-oxidation alloy, which contains iron, cobalt, nickel and at least 4% to 5% by weight of aluminum, and the aluminum has at least one dual-phase crystal structure. The anti-oxidation alloy has a relatively low coefficient of thermal expansion at 427° C., lower than about $13\times10^{-6}/°$ C., and is characterized by resistance to oxygen embrittlement, and its characteristics also include that in terms of notch ductility at about 650° C., in the state of annealing and age hardening, the anti-oxidation alloy is mainly composed of about 25-50% nickel, about 5-50% cobalt, about 45-75% nickel plus cobalt, and about 4-10% aluminum, about 0~2% titanium, 0~0.2% carbon, 0~6% chromium, 0~2% manganese, 0~0.5% silicon, 0~5% molybdenum and tungsten, about 0~6% niobium, 0~0.1% zirconium, 0~0.02% boron by weight, basically balanced iron in the range of 20% to 50% and incidental impurities. In terms of the mechanical properties of the anti-oxidation alloy at room temperature, the tensile strength is about 900 MPa, the yield strength is about 650 MPa, and the elongation is up to about 10%; and in terms of the mechanical properties at 760° C., the tensile strength is at least 550 MPa, the yield strength is at least 500 MPa, the elongation is at least 5%; and the alloy density is at least 7.72 g/cc. The claims only emphasize the constituent elements of the alloy, and do not mention the mechanical properties and density of the alloy.

U.S. Pat. No. 5,425,912 discloses a high-temperature alloy with high-strength and low coefficient of thermal expansion, which shows improved toughness in a wide temperature range as low as about 4° K. The high-temperature alloy is suitable for forging superconducting sheaths. The high-temperature alloy has high strength and toughness, and low thermal expansion coefficient, and is mainly composed of about 45-55% nickel, about 3-6% chromium, about 1.2-2.1% titanium, about 0-25% cobalt, about 0.25~1.25% niobium, about 0.5~1.5% aluminum, about 0~3% molybdenum, 0.001% or less carbon, about 0~2% manganese, about 0~1% silicon, about 0~0.03% boron, about 45-60% nickel and cobalt, trace impurities and the balance iron. This patent performs improvement based on Incoloy® alloy 908 alloy.

The invention of U.S. Pat. No. 5,476,555 relates to a nickel-cobalt-based alloy, which includes the following elements by weight percentage: about 0.002 to 0.07% carbon, about 0 to 0.04% boron, and about 0 to 2.5% niobium, about 12~19% chromium, about 0~6% molybdenum, about 20~35% cobalt, about 0~5% aluminum, about 0~5% titanium, about 0~6% tantalum, about 0~6% tungsten, about 0~2.5% vanadium, about 0~0.06% zirconium and the balance nickel plus incidental impurities. This patent performs improvement based on Waspaloy® and MP210 alloys.

U.S. Pat. No. 6,730,264 discloses a nickel-based alloy comprising the following composition by weight percentage: up to 0.10% carbon, about 12% to about 20% chromium, up to about 4% molybdenum, up to about 6% tungsten, wherein the sum of molybdenum and tungsten is at least about 2% and not more than about 8%, about 5% to 12% cobalt, up to about 14% iron, about 4% to 8% niobium, about 0.6% to 2.6% aluminum, about 0.4% to about 1.4% titanium, about 0.003% to 0.03% phosphorus, about 0.003% to 0.015% boron, nickel and incidental impurities. The sum of the atomic percentage of aluminum and the atomic percentage of titanium is about 2 to 4%. The ratio of the atomic percentage of aluminum to the atomic percentage of titanium (aluminum/titanium) is at least about 1.5, and the atomic percentage of aluminum plus titanium divided by the atomic percentage of niobium (aluminum+titanium/niobium) is about 0.8 to 1.3. The nickel-based alloy can be provided in the form of articles, such as disks, blades, fasteners, housings, or shafts. This patent also discloses a method for manufacturing a nickel-based alloy. This patent performs improvement based on Waspaloy® and MP210 alloy.

U.S. Pat. No. 7,156,932 discloses that its embodiments relate to nickel-based alloys, especially 718-type nickel-based alloys. The nickel-based alloy has the required microstructure, which is mainly enhanced by γ' phase precipitates and contains a certain amount of at least one grain boundary precipitate. Other embodiments of the patent relate to a method of thermal treatment of nickel-based alloys, especially 718-type nickel-based alloys, to develop a desired microstructure capable of imparting thermally stable mechanical properties. The patent also discloses a method of using the nickel-based alloy products and thermally treated nickel-based alloy according to its embodiments. This patent is improved based on In718 alloy.

U.S. Pat. No. 8,394,210 discloses a nickel-based alloy with good toughness and thermal fatigue resistance. Based on the total weight of the alloy, the nickel-based alloy includes: 9-12% chromium, 25-35% iron, 1~3% molybdenum, 3.0~5.5% niobium, 0.2~2.0% aluminum, 0.3~3.0% titanium, 0.10% or less carbon, no more than 0.01% boron, nickel and incidental impurities. The patent also discloses a die-casting mold made of the nickel-based alloys or a die-casting mold including the nickel-based alloy, as well as other tools and other products. The claims of this patent mainly include alloy composition ratios and different element ratios of aluminum and titanium, and do not mention the mechanical properties and density of the alloy. And because the constituent elements contain iron, it is judged that this nickel-based alloy is not improved based on In713 alloy.

The R.O.C. patent No. 202022132A provides a multi-element alloy containing carbon, aluminum, tungsten, cobalt and nickel, and based on the total weight of the multi-element alloy, the content of carbon is 0.01~1.2%, the content of aluminum is 3~10%, the content of tungsten is 3.5~20%, the content of cobalt is 20~32%, and the content of nickel is 38~65%. The multi-element alloy has good mechanical properties at high temperatures, which can improve wear resistance and reduce processing cost.

The R.O.C. patent No. 202022126A discloses a nickel-based austenite alloy and its manufacturing method. In this manufacturing method, by processing an alloy blank with a specific composition to a specific compression ratio, a nickel-based austenite alloy with high temperature strength and ductility is obtained. This patent provides an alloy blank, which contains: by weight percentage (wt. %), up to 4.5% molybdenum, 0.5~1.5% titanium, 0.02~0.08% carbon, 30~54% nickel, 15~25% chromium, 1.0~3.5% copper, less than or equal to 1.0% silicon, less than 3% other elements, and the balance iron. Wherein, at a temperature of 600° C. to 900° C., the nickel-based austenite alloy has a tensile strength of at least 115 Pa, a yield strength of at least 65 Pa, and an elongation of at least 45%.

In recent years, due to the rising awareness of environmental protection, supercharged engines have gradually become a trend. Among supercharged engines, turbocharger has greater compression efficiency than supercharger and is relatively fuel-efficient. Therefore, turbo engines are gradually applied to automobiles. Turbocharger uses exhaust gas to push turbine blades and push a large amount of air into the cylinder such that power and efficiency of the car can be greatly increased without increasing exhaust emissions.

However, although the turbo engine has the advantages of increasing horsepower and reducing exhaust gas, it has the inevitable turbo lag phenomenon. To improve this shortcoming, it is usually possible to make the turbine not only be driven by exhaust gas by adding a turbine or an electric motor, but this will increase the overall weight of the car. Therefore, reducing the weight of the turbine material to reduce its rotational inertia is the most fundamental way to solve the turbine lag and also the main purpose of this invention.

In view of the above, the inventor, having years of rich experience in design, development and actual production in the related industry, does the researches and improvement with respect to the existing structure and deficiencies, and provides a low-density, high-strength nickel-based superalloy and its material in order to achieve the purpose of better practical value.

BRIEF SUMMARY OF THE INVENTION

In view of the shortcomings of the above known technology, the main purpose of the present invention is to provide a low-density and high-strength nickel-based superalloy and its materials, which can reduce the weight of the Inconel® 713LC nickel-based superalloy by adding light elements, and to study the various influences and the mechanisms after addition. In this way, the mechanical properties of the nickel-based superalloy cannot be affected or exceed that of Inconel® 713LC under the composition design that reduces the density of the nickel-based superalloy.

In order to achieve the above object, according to one aspect proposed by the present invention, a nickel-based superalloy material is provided. The nickel-based superalloy material comprises 0.06 wt % or less carbon, 11.61~11.93 wt % chromium, 1.52~2.85 wt % titanium, 5.89~6.08 wt % aluminum, 0.009 wt % or less boron, 0.07 wt % or less zirconium, 2.16~2.18 wt % niobium, 4.22~4.29 wt % molybdenum, and the balance being composed of nickel and incidental impurities.

In order to achieve the above object, according to one aspect proposed by the present invention, a nickel-based superalloy is provided. The nickel-based superalloy is made from the nickel-based superalloy material described above and has the following mechanical properties: a tensile strength of at least 1010 MPa, a yield strength of at least 925 MPa, an elongation of at least 3.0%, and an alloy density of less than 7.79 g/cm$^3$ at a temperature greater than 650° C.

Preferably, the nickel-based superalloy has the following component ratio: 0.06 wt % carbon, 11.61 wt % chromium, 2.85 wt % titanium, 6.08 wt % aluminum, 0.009 wt % boron, 0.07 wt % zirconium, 2.16 wt % niobium, 4.22 wt % molybdenum, and the balance being composed of nickel and incidental impurities.

Preferably, the nickel-based superalloy has the following mechanical properties: the tensile strength of 1130 MPa, the yield strength of 960 MPa, the elongation of 6.2%, and the alloy density of less than 7.79 g/cm$^3$ at the temperature greater than 650° C.

Preferably, the nickel-based superalloy has the following component ratio: 0.06 wt % carbon, 11.93 wt % chromium, 1.52 wt % titanium, 5.89 wt % aluminum, 0.009 wt % boron, 0.07 wt % zirconium, 2.18 wt % niobium, 4.29 wt % molybdenum, and the balance being composed of nickel and incidental impurities.

Preferably, the nickel-based superalloy has the following mechanical properties: the tensile strength of 1010 MPa, the yield strength of 925 MPa, and the elongation of 3.0% at the temperature greater than 650° C.

The above summary, the following detailed description and drawings are all for the purpose of further explaining the methods, means and effects adopted by the present invention to achieve the intended purpose. Other objects and advantages of the present invention will be described in the following description and drawings.

BRIEF DESCRIPTION OF THE DRAWINGS

FIG. 3 is a comparison diagram of the alloy mechanical properties of the nickel-based superalloy materials having three different alloy addition amounts of the present invention.

DETAILED DESCRIPTION OF THE INVENTION

Figure 1:
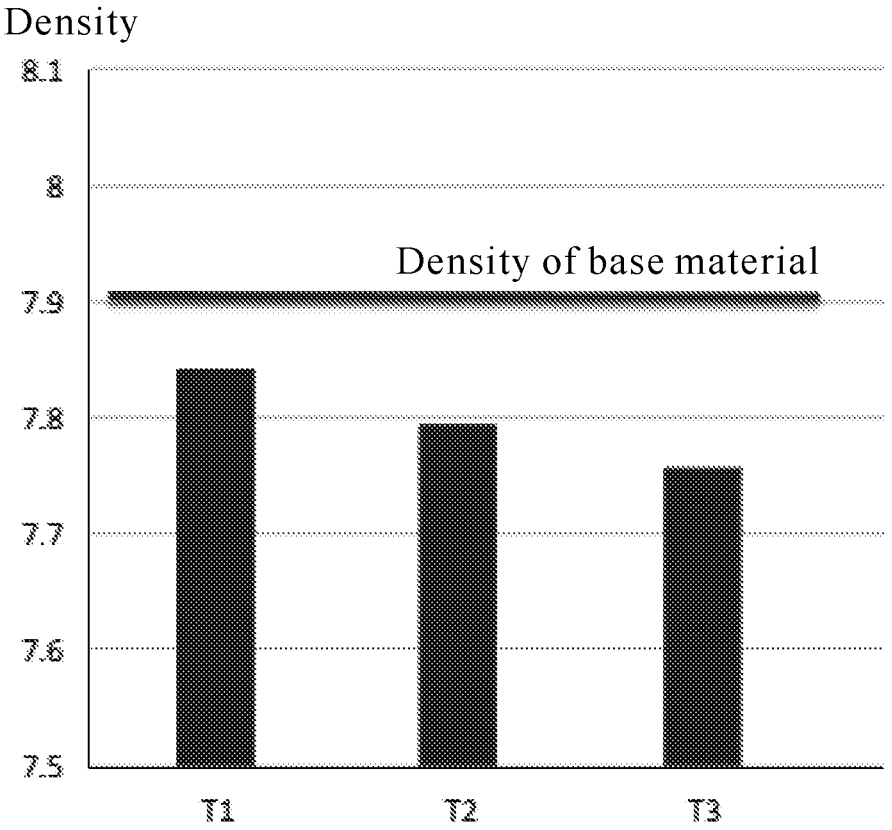
FIG. 1 is a comparison diagram of the alloy density of the nickel-based superalloy materials having three different alloy addition amounts of the present invention.

To facilitate understanding of the object, characteristics and effects of this present disclosure, embodiments together with the attached drawings for the detailed description of the present disclosure are provided.

Nickel-based superalloys are based on nickel and contain more than a dozen other chemical elements. Different elements have different strengthening effects on nickel-based superalloys. Nickel-based superalloys are mainly composed of γ phase (continuous FCC substrate), γ' phase (main precipitation phase) and carbide (mainly MC, M23C6), in which γ' phase and carbide are the main strengthening mechanism in the nickel-based superalloys, and their quantity, distribution position and morphology have a great influence on the mechanical properties of the nickel-based superalloys in the working environment.

Based on the existing nickel-based superalloy materials on the market, the physical and mechanical properties of nickel-based superalloy materials are changed by the addition of different elements. For example, new nickel-based superalloy materials are developed by reducing the density of nickel-based superalloys and maintaining or increasing the mechanical characteristics of the material under different working environments. In this way, not only can the cost of research be reduced, but the price of the developed product will be more competitive in the market.

In terms of the nature of the technology, reducing the weight of the working material in the turbine to reduce its rotational inertia is a relatively effective solution to the lag of the turbine. The blades for compressing air in the turbine have mostly adopted lightweight alloys. However, the turbine blades for the intake of engine exhaust gas have to withstand the high heat of the exhaust gas and the centrifugal stress and shear stress of high-speed rotation, and nickel-based superalloys have become more important. Inconel® 713LC nickel-based superalloy is a material that has been developed for a long time. It has a lower production cost in the market and helps related products to compete in the market. Therefore, the Inconel® 713LC nickel-based superalloy is reduced in weight by adding light elements (aluminum, titanium) with low density. After the addition of light elements, the various characteristics and mechanisms of the material can achieve the purpose that the mechanical properties of nickel-based superalloys are not affected or exceed that of Inconel® 713LC under the composition design that reduces the density of the nickel-based superalloy.

In the related research of nickel-based superalloys, the addition of low-density elements has a significant impact on the characteristics of nickel-based superalloys. For example, the γ' phase of titanium element in nickel-based superalloys will produce stable intermetallic compounds $Ni_3Ti$ integrated precipitates, so it has the effect of precipitation strengthening to improve mechanical properties, and at the same time it will produce TiC or Ti(C,N) non-integration precipitates. If the Ti content is increased, TiC will increase, and grain boundary liquefaction may occur at high temperatures, thereby reducing the high-temperature ductility of the nickel-based superalloy. Titanium oxide, $TiO_2$, is an oxide layer that is not dense and has large pores. It will increase with the addition of titanium, so oxygen is more likely to enter the nickel-based superalloy, thereby reducing the reliability of the nickel-based superalloy at high temperatures, which has a bad influence on the properties of the nickel-based superalloy, and other elements may be added to improve this situation.

In addition, the ratio of titanium to tantalum will affect the final interdendritic liquid during the solidification process, thereby affecting its castability. During the solidification process of the IN792 nickel-based superalloy, the final interdendritic liquid can be represented by $Ni_{75}(Ta_{25}\text{-}xTix)$, and when x is 18-20, its thermal cracking sensitivity will be higher, which will affect the casting properties. In addition, in the U720Li(TMW-1) nickel-based superalloy, the higher the titanium content, the larger the Ti/Al ratio, so the volume fraction of the γ' phase also increases correspondingly, the grain size is also smaller, and titanium will form η phase ($Ni_3Ti$) with nickel, which further increases the strength of the alloy.

In addition, under the creep condition of 750° C./310 MPa, when the ratio of titanium to aluminum increases from 0.14 to 1.22, the creep life also increases from 71 hours to 283 hours. However, as the ratio of titanium to aluminum continues to rise, the creep life is reduced due to the precipitation of $Ni_3Ti$ at the grain boundary. When the Ti/Al ratio is about 1.22, the longest creep life appears, in which the elongation at break and the shrinkage of break surface are higher than 5% and 9.7%, respectively.

Figure 2:
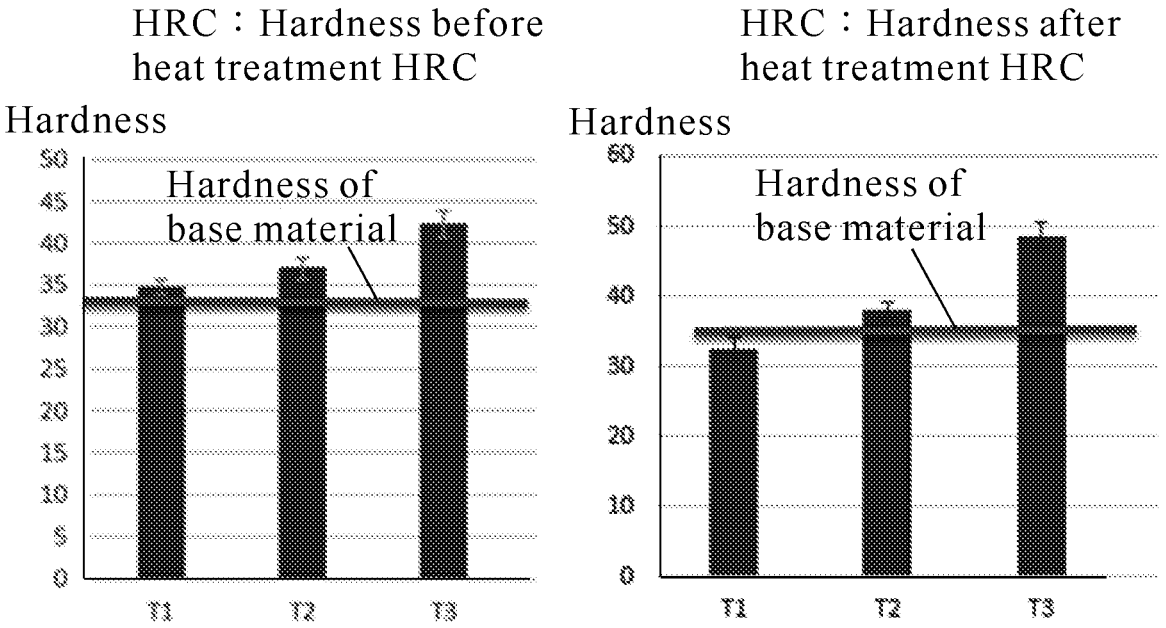
FIG. 2 is a comparison diagram of the hardness of the nickel-based superalloy materials having three different alloy addition amounts of the present invention before and after the heat treatment.

Please refer to FIGS. 1 to 3. In the present invention, different amounts of titanium element were added to the In-713LC (Inconel® 713LC) material to make nickel-based superalloys T1, T2, and T3. The addition amounts are shown in the table below. After being smelted into a test bar, further analysis of the composition, density, hardness, and mechanical properties were performed.

TABLE 1

The content of titanium added to In-713LC

| Element | Base material (wt %) | T1 (wt %) | T2 (wt %) | T3 (wt %) | In713LC (wt %) |
|---|---|---|---|---|---|
| C | 0.04 | 0.06 | 0.06 | 0.06 | 0.03-0.07 |
| Cr | 11.80 | 11.93 | 11.61 | 11.34 | 11.0-13.0 |
| Ti | 0.63 | 1.52 | 2.85 | 4.42 | 0.4-1.0 |
| Al | 5.78 | 5.89 | 6.08 | 6.33 | 5.5-6.5 |
| B | 0.008 | 0.009 | 0.009 | 0.008 | 0.0-0.015 |
| Zr | 0.07 | 0.07 | 0.07 | 0.07 | 0.05-0.15 |
| Nb | 2.25 | 2.18 | 2.16 | 2.13 | 1.5-2.5 |
| Mo | 4.41 | 4.29 | 4.22 | 4.09 | 3.8-5.2 |
| Ni | bal. | bal. | bal. | bal. | bal. |

As described in the above, the nickel-based superalloy material of the present invention includes: 0.06 wt % or less carbon, 11.34~11.93 wt % chromium, 1.52~4.42 wt % titanium, 5.89~6.33 wt % aluminum, 0.009 wt % or less boron, 0.07 wt % or less zirconium, 2.13~2.18 wt % niobium, 4.09~4.29 wt % molybdenum, and the balance being composed of nickel and incidental impurities.

In this embodiment, please refer to FIG. 1. The nickel-based superalloys T1, T2, and T3 are made from the above-mentioned composition ratios. Take an unprocessed test rod of appropriate size to measure its wet weight and water weight and dry weight, respectively for finding its volume and calculating its actual density. In terms of density, compared to the original In-713LC base material density of 7.91 $g/cm^3$, the density of the nickel-based superalloy T2 after adding titanium is reduced to 7.79 $g/cm^3$, which is about 1.5% less dense. Taking the actually produced ingot size as an example, the diameter is 35 cm and the height is 200 cm, resulting in the reduction of weight by approximately 1.5 kg. In addition, the density of nickel-based superalloy T3 after titanium addition is reduced to 7.76 $g/cm^3$.

In this embodiment, please refer to FIG. 2 to compare the hardness of the nickel-based superalloys T1, T2, and T3 before and after heat treatment. Except for the nickel-based superalloy T1, both the other nickel-based superalloys T2 and T3 have higher hardness after the heat treatment than those before the heat treatment. With the addition of titanium, the hardness rises significantly, and the hardness of the nickel-based superalloy T3 even reaches 48.7.

In addition, please refer to FIG. 3. It can be found in the tensile results at medium temperature (650° C.) that the tensile strength and yield strength increased with the addition of titanium (nickel-based superalloys T1~T2), while the nickel-based superalloy T3 dropped significantly. It is speculated that the reason may be the substantial growth of the eutectic phase, and the material is easy to fracture at the layered site of the eutectic phase, which causes the material's tensile strength and yield strength to drop sharply.

In this embodiment, please refer to FIG. 3. As far as the mechanical properties of the nickel-based superalloy are concerned, the nickel-based superalloys T1 and T2 have the tensile strength of at least 1010 MPa, the yield strength of at least 925 MPa and the elongation of at least 3.0% at the temperature greater than 650° C., while the alloy density of nickel-based superalloys T2 and T3 is less than 7.79 g/cm$^3$.

More specifically, when the composition ratio of the nickel-based superalloy T2 is 0.06 wt % carbon, 11.61 wt % chromium, 2.85 wt % titanium, 6.08 wt % aluminum, 0.009 wt % boron, 0.07 wt % zirconium, 2.16 wt % niobium, 4.22 wt % molybdenum and the balance being composed of nickel and incidental impurities, in terms of the mechanical properties of nickel-based superalloy T2, the nickel-based superalloy T2 has a tensile strength of 1130 MPa, a yield strength of 960 MPa, an elongation of 6.2% and an alloy density of less than 7.79 g/cm$^3$ at a temperature greater than 650° C.

In addition, when the composition ratio of the nickel-based superalloy T1 is 0.06 wt % carbon, 11.93 wt % chromium, 1.52 wt % titanium, 5.89 wt % aluminum, 0.009 wt % boron, 0.07 wt % zirconium, 2.18 wt % niobium, 4.29 wt % molybdenum and the balance being composed of nickel and incidental impurities, in terms of the mechanical properties of the nickel-based superalloy T1, the nickel-based superalloy T1 has a tensile strength of 1010 MPa, a yield strength of 925 MPa and an elongation of 3.0% at a temperature greater than 650° C.

In summary, Inconel® 713LC alloy has the advantages of good mechanical properties at medium to high temperature and low cost. It has been widely used in the turbine of automotive turbochargers, but its strength will drop sharply when used in the high temperature environment of gasoline vehicles. Utilizing the existing components in the material and properly adjusting the proportions, adding titanium for low-density ratio adjustment to Inconel® 713LC alloy to improve its high-temperature mechanical properties, materials suitable for diesel and gasoline vehicle turbines can be developed. In addition, in aerospace, power generation, national defense and other related use conditions, such as aircraft rising from the ground to high altitude, or when the device is working at high temperatures, regardless of whether the working environment is static or dynamic, in addition to the stress generated by the power itself, the thermal stress generated from the internal temperature variation of the environment and the system or device also causes a great burden on the material during the use of the material. The nickel-based superalloy materials developed by this research are suitable for boilers, turbine generator blades in power plant technology, and turbine blades of supercritical or ultra-supercritical steam turbine generators and related operating temperature devices. In particular, the technology of the present invention can avoid improper materials from causing damage to the system or device, or even causing damage to personnel and materials, in response to the application requirements of the device or system.

While the present disclosure has been described by means of specific embodiments, numerous modifications and variations could be made thereto by those skilled in the art without departing from the scope and spirit of the present disclosure set forth in the claims.

What is claimed is:

1. A nickel-based superalloy material, comprising:

0.06 wt % or less carbon, 11.61~11.93 wt % chromium, 1.52~2.85 wt % titanium, 5.89~6.08 wt % aluminum, 0.009 wt % or less boron, 0.07 wt % or less zirconium, 2.16~2.18 wt % niobium, 4.22~4.29 wt % molybdenum, and the balance being composed of nickel and incidental impurities.

2. A nickel-based superalloy, made from the nickel-based superalloy material of claim 1, and having the following mechanical properties: a tensile strength of at least 1010 MPa, a yield strength of at least 925 MPa, an elongation of at least 3.0%, and an alloy density of less than 7.79 g/cm$^3$ at a temperature greater than 650° C.

3. The nickel-based superalloy of claim 2, wherein the nickel-based superalloy has the following component ratio: 0.06 wt % carbon, 11.61 wt % chromium, 2.85 wt % titanium, 6.08 wt % aluminum, 0.009 wt % boron, 0.07 wt % zirconium, 2.16 wt % niobium, 4.22 wt % molybdenum, and the balance being composed of nickel and incidental impurities.

4. The nickel-based superalloy of claim 3, wherein the nickel-based superalloy has the following mechanical properties: the tensile strength of 1130 MPa, the yield strength of 960 MPa, the elongation of 6.2%, and the alloy density of less than 7.79 g/cm$^3$ at the temperature greater than 650° C.

5. The nickel-based superalloy of claim 2, wherein the nickel-based superalloy has the following component ratio: 0.06 wt % carbon, 11.93 wt % chromium, 1.52 wt % titanium, 5.89 wt % aluminum, 0.009 wt % boron, 0.07 wt % zirconium, 2.18 wt % niobium, 4.29 wt % molybdenum, and the balance being composed of nickel and incidental impurities.

6. The nickel-based superalloy of claim 5, wherein the nickel-based superalloy has the following mechanical properties: the tensile strength of 1010 MPa, the yield strength of 925 MPa, and the elongation of 3.0% at the temperature greater than 650° C.

* * * * *